United States Patent [19]

Stutz

[11] 4,334,402

[45] Jun. 15, 1982

[54] APPARATUS FOR LUBRICATING A RING TRAVELLER OF A RING SPINNING OR RING TWISTING FRAME

[75] Inventor: Emil Stutz, Winterthur, Switzerland

[73] Assignee: Bräcker AG, Pfäffikon, Switzerland

[21] Appl. No.: 199,511

[22] PCT Filed: Jul. 26, 1979

[86] PCT No.: PCT/CH79/00106

§ 371 Date: Apr. 7, 1980

§ 102(e) Date: Mar. 25, 1980

[87] PCT Pub. No.: WO80/00355

PCT Pub. Date: Mar. 6, 1980

[30] Foreign Application Priority Data

Aug. 7, 1978 [CH] Switzerland ..... 8 366/78

[51] Int. Cl.[3] ..... D01H 7/62

[52] U.S. Cl. ..... 57/120; 57/124

[58] Field of Search ..... 57/120, 124; 184/7 A

[56] References Cited

U.S. PATENT DOCUMENTS

| | | | |
|---|---|---|---|
| 2,867,076 | 1/1959 | Atwood | 57/120 |
| 2,905,269 | 9/1959 | Mulholland | 184/7 A |
| 3,338,045 | 8/1967 | Kaiser | 57/120 |
| 3,669,219 | 6/1972 | Wayson et al. | 184/7 A |
| 3,866,404 | 2/1975 | Doleman et al. | 57/120 X |
| 4,098,067 | 7/1978 | McLean | 57/120 |

FOREIGN PATENT DOCUMENTS

| | | | |
|---|---|---|---|
| 2111515 | 6/1972 | France | 57/120 |

*Primary Examiner*—Donald Watkins
*Attorney, Agent, or Firm*—Werner W. Kleeman

[57] ABSTRACT

A process and apparatus for lubricating a ring traveler of ring spinning or ring twisting frame is disclosed in which lubricant is supplied to the ring traveller (18) and to the contact surface between the spinning or twisting ring (12, 16) and the ring traveller (18) from a lubricant store (24), which is disposed on the inside of the spinning or twisting ring (12) and which is provided on its upper side with lubricant outlet openings. The air current which rises during the spinning or twisting serves to convey the lubricant. Such lubrication makes it possible to operate the ring traveller (18) at a greater rotational speed, without increasing its wear. The productivity of the machine is thus increased by this a greater rotational speed.

8 Claims, 8 Drawing Figures

Fig. 1
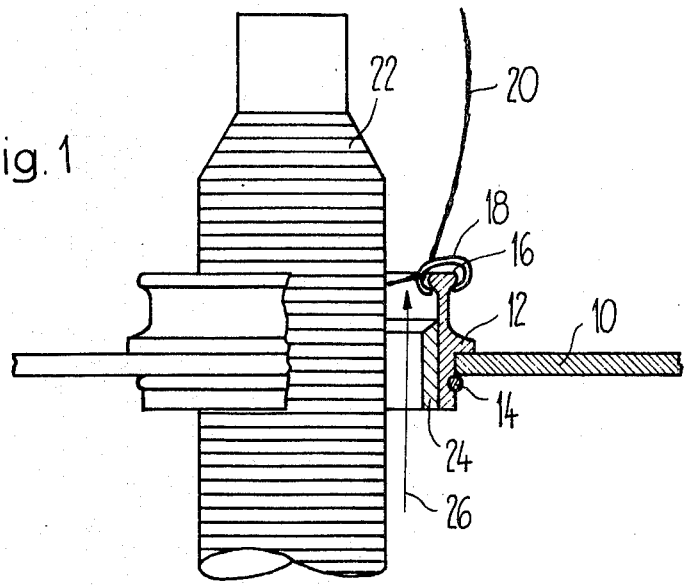
Fig. 2
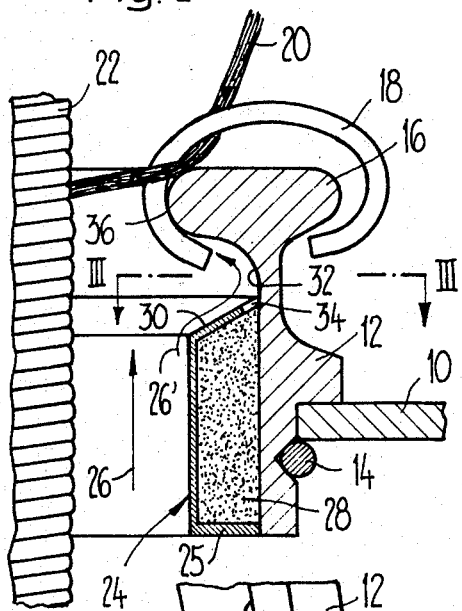
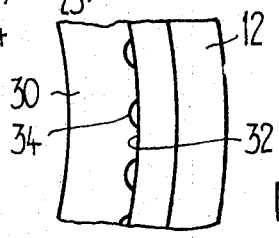
Fig. 3
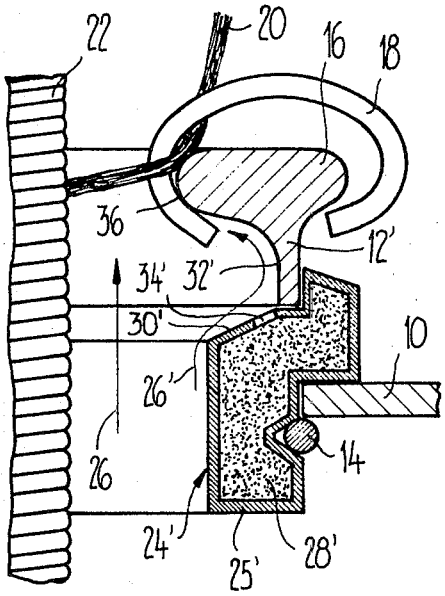
Fig. 4

APPARATUS FOR LUBRICATING A RING TRAVELLER OF A RING SPINNING OR RING TWISTING FRAME

BACKGROUND OF THE INVENTION

The invention relates to a process for lubricating a ring traveller rotating on a spinning or twisting ring of a ring spinning or ring twisting frame, and also to an apparatus for carrying out the process. More particularly, the present invention relates to a method and apparatus for lubricating the ring traveller by utilizing the air current created by the spinning or twisting action of the device.

The ring traveller, which rotates at a high speed, as well as the spinning or twisting ring or flange thereof, are subject to considerable wear caused by friction. The capacity of a ring spinning or ring twisting frame is therefore generally limited by the speed of the ring traveller, which, in the case of a ring traveller operating without a lubricating device and made of steel, is approximately 40 m/s. At higher speeds, the wear of the ring traveller increases to an uneconomical extent and there is also an increased number of breaks in the thread.

It is known that flanged rings with a T-shaped profile are used, almost without exception, without a lubricating device. The ring traveller rotating on such a ring is, however, slightly lubricated, e.g. when processing cotton, by the fat which is contained in the cotton and is released. However, such a lubrication is incomplete. It cannot be ensured that a sufficient proportion of the amount of fat, which in any case is very small, also reaches the contact surface. This is the surface which is subject to wear, between the ring and the ring traveller.

It is also known that cylindrical rings with a vertically extending profile and conical rings which are intended for ring travellers made of steel are provided on their contact surface with an oil-impregnated wick. The wick is inserted in a groove for lubricating the ring traveller. The groove is disposed in the region of the contact area between ring and ring traveller, so that the contact surface is interrupted and reduced by the groove. As a result thereof, it is possible for an increased surface pressure to occur, particularly at the edges of the groove, which in turn may again lead to a premature wear of the ring traveller. When such wicks are used, there is also a risk of an overdosage of lubricant, which may soil the yarn which is to be processed.

Another known arrangement, particularly for ring travellers made of plastic, is provided with an oil-impregnated ring made of a sintered material. Such an arrangement permits a uniform distribution of the oil film on the contact surface. However, the contact surface which is broken by the pores of the sintered material has less favorable friction properties than a polished surface, particularly when the pores are blocked.

In this arrangement there is also a risk of soiling the yarn which is to be processed with excess oil. A prior art device is known from German Pat. No. AS 1 109 575.

SUMMARY AND OBJECTS OF THE INVENTION

It is a primary object of the present invention to provide a process for lubricating a ring traveller, which permits a considerable increase in the speed of the traveller, without increasing the wear of the ring traveller or of the spinning or twisting ring to unacceptable values.

It is also an object of the present invention to provide a process and apparatus for lubricating the ring traveller and the contact surface between the ring traveller and the spinning or twisting ring by utilizing the air current created by the spinning or twisting action of the device.

The process according to the present invention permits a uniform distribution of the lubricant, so that a supply of lubricant to the contact surfaces which are subject to the greatest wear is also guaranteed. It has been shown that traveller speeds of up to 100 m/s are possible by means of such lubrication, without a considerable increase in the wear of the ring traveller. The process according to the present invention thus makes possible a considerable increase in the productivity of a ring spinning or ring twisting frame.

By the choice and arrangement of the outlet openings, the quantity of lubricant which is supplied can be metered. Thus the desired result of adequate lubrication is guaranteed, and the yarn which is to be processed is not soiled.

According to a preferred embodiment, it is possible to use the air current which, during spinning or twisting, flows upwardly from below in the direction of the contact surface of the spinning or twisting ring to supply the lubricant. This air current is produced by the revolving yarn, which forms a balloon, during the spinning or twisting operation. As this air current is not present when the machine is not operating, the lubricant is only supplied when the machine is running, so that an overdosage of lubricants is definitely avoided.

This upwardly directed air current creates an underpressure between the cop and the inside of the spinning or twisting ring. The suction effect of this air current is used to suck the lubricant, out of the lubricant outlet openings. The lubricant may preferably be liquid, and particularly, oil. In its apparatus aspects, the present invention is characterized by a store containing the lubricant, or at least an outlet opening thereof, is provided in the flow direction of the air, in front of the contact surface between the ring traveller and the spinning or twisting ring.

With these and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 1 shows an embodiment of the present device for lubricating a spinning or twisting ring with a T-shaped profile, the right half of which is shown cut open;

FIG. 2 shows a section from FIG. 1 on a larger scale;

FIG. 3 shows a sectional view according to the section line III—III of FIG. 2;

FIG. 4 shows a variant of FIG. 2;

DETAILED DESCRIPTION OF THE PREFERRED EMBODIMENT

Figure 5:
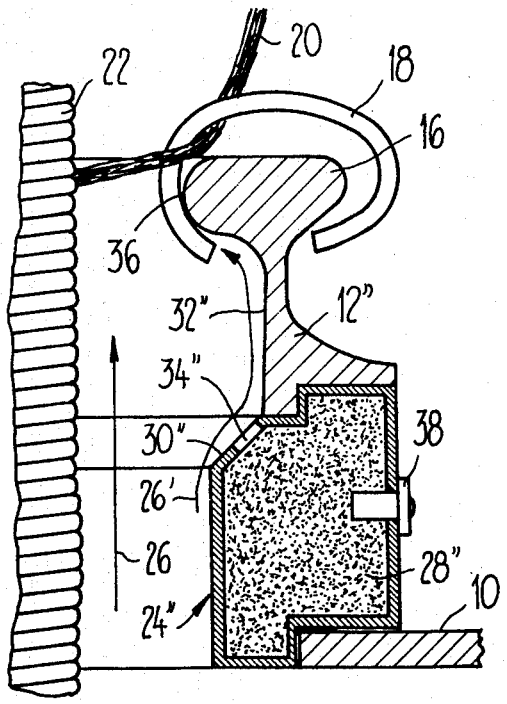
FIG. 5 shows a further variant of FIG. 2.

Referring now in detail to the drawings wherein like parts are designated by like reference numerals throughout, in FIG. 1 a spinning or twisting ring 12, hereafter briefly indicated as a ring, is secured on a ring rail 10 of a ring spinning or ring twisting frame by means of an expanding ring 14. A ring traveller 18 is provided on on the flange 16 of the ring 12. A thread 20, which is to be spun or twisted, is deflected and wound onto a cop 22 by means of the ring traveller 18. The rotating cop 22 causes the ring traveller 18 to take up a circular path on the flange 16 of the ring 12. The winding of the thread 20 onto the cop 22 is made possible by the fact that the ring traveller 18 slips with respect to the cop as a result of friction.

An annular store 24, which is filled with lubricant, is provided on the inside of the ring 12. Air flows upwards in the direction of the arrow 26 through the rings 12 and 24 during spinning. This air current 26 is caused by the high rotational speed of the thread 20 forming a balloon and/or of the ring traveller 18. The lubricant store 24 has outlet openings, which will be described below in detail, from which lubricant is supplied to the ring traveller 18 and the flange 16 of the ring 12 by means of the air current 26.

In FIG. 2, the location of the section of the flanged ring 12 is shown on a larger scale than in FIG. 1. It can be seen from FIG. 2 that the lubricant store 24 comprises a container 25, containing an element 28 of sintered material for absorbing the liquid lubricant, particularly oil. The upper side 30 of the lubricant store 24 which faces the flange 16 of the ring 12 extends diagonally upwards in the direction of the larger diameter and is provided with lubricant outlet openings 34 adjacent to the inner side 32 of the ring 12. As can be seen from FIG. 3, the lubricant outlet openings 34 are distributed at equal distances over the entire circumference of the annular lubricant store 24.

A branch current 26' of the air current 26 according to the Coanda effect ensues as a result of the slope of the upper side 30 of the lubricant store 24. This branch current 26' accordingly flows along the upper side 30 and subsequently along the inner side 32 of the ring 12. As a result of this air current 26', an underpressure arises at the outlet openings 34, through which lubricant is sucked from the store 24. According to its quality and the speed of the air currents, the lubricant can now either be carried along in a very finely atomized form by the air current 26', the air current serving as a carrier medium, or it may be advanced in liquid form as a boundary layer flow along the surface 32 by the air current. In both ways, the lubricant reaches the contact surface 36, which is subject to the greatest wear, between the ring 12, 16 and the ring traveller 18 in such a fine dosage that the thread 20 is prevented from becoming soiled. A further advantage is the fact that the supply of lubricant is limited to the period during which the machine is operating, so that an overdosage is definitely prevented.

It is also conceivable to replace the liquid lubricant by solid lubricants, which are directly converted from a solid to a gaseous state and which leave a deposit on the contact surface 36 which is to be lubricated. It is also possible to directly use gaseous lubricants or those which convert from a liquid to a gaseous state.

In contrast to the embodiment shown in FIG. 2, an annular lubricant store 24' with a larger capacity is arranged in the embodiment shown in FIG. 4. This lubricant store 24' replaces the lower part of the ring 12' and is secured on the ring rail 10 by an expanding ring 14. This lubricant store 24' serves as a carrier for the ring 12' and has lubricant outlet openings 34' distributed over its periphery. The upper side 30' of the lubricant store 24' which is adjacent to the inner side 32' of the ring 12' slopes in the same manner as that shown in FIG. 2, so as to pass the branch air current 26' according to the Coander effect over the surfaces 30' and 32'. Due to the resultant underpressure in the space of the lubricant outlet openings 34', lubricant is delivered from the porous material 28' to the contact surface 36 between the flange 16 of the ring 12' and the ring traveller 18. The porous material 28', for example a sintered material, is surrounded by a container 25', which is provided with the outlet openings 34'. It is also conceivable to use sintered material in the form of an annular sintered element, without such a container as a carrier for the ring 12', or to cover only a few of its surfaces with an impermeable material. In such an embodiment, the pores at the surface of the sintered material serve as lubricant outlet openings.

FIG. 5 shows another variant, in which an enlarged annular lubricant store 24'' is arranged between the ring rail 10 and the ring 12''. In this embodiment, the outlet openings 34'' are also disposed on the sloping upper side 30'' of the store 24'' adjacent to the inner side 32'' of the ring 12''. A lubrication nipple 38 is disposed on the outside of the store 24'' in order to top up this store with lubricant. The core of the lubricant store forms a porous material 28''.

Figure 6:
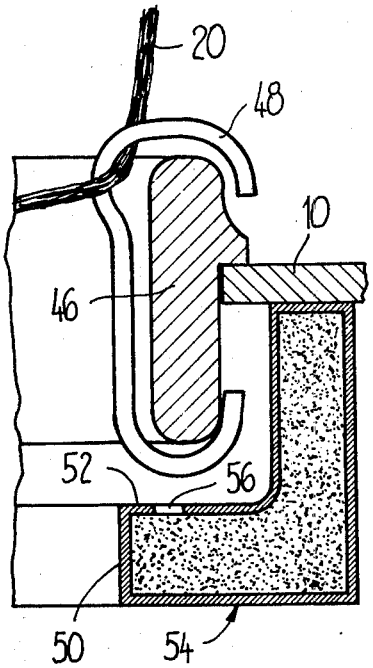
FIG. 6 shows a device for lubricating a cylindrical spinning or twisting ring with a vertically extending profile.

FIG. 6 shows a device with a cylindrical ring 46, the profile of which extends in the vertical direction. A ring traveller 48 is provided on this ring 46. The ring 46 is secured to the ring rail 10, to which a lubricant store 54 is also secured. The lubricant store 54 has an annular shape and its profile has an angular cross section. The horizontal side 50 of the angular profile is arranged below the ring 46 and is provided on its upper side 52 with lubricant outlet openings 56. Although the upper side 52 is illustrated horizontally, it can also be arranged at an angle, in a manner similar to that of the previous embodiments.

Figure 7:
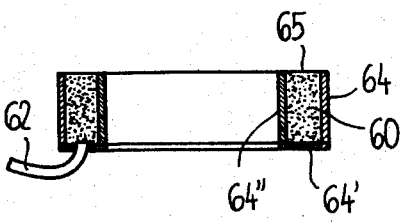
FIG. 7 shows a sectional view through a sintered ring provided as a lubricant store and FIG. 8 shows a sectional view through a ring with a coiled capillary tube.

FIG. 7 shows a longitudinal section of a sintered metal ring 60, which serves as a lubricant store. Liquid lubricant is supplied to this ring via a capillary tube 62. The lower side of this ring, its surface area and its inside are closed by plates 64, 64', 64''.

The pores of the sintered metal serve as lubricant outlet openings at the open surface 65 of this ring.

Figure 8:
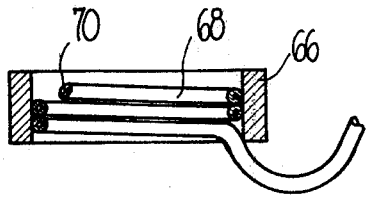

FIG. 8 shows the longitudinal section of a ring, on the inside of which a capillary tube 68 is provided in the shape of a coil. The end 70 of this capillary tube serves as a lubricant outlet opening. The other end of the capillary tube is connected to a lubricant reservoir, which is not shown. This ring 66 is provided for mounting on a spinning ring, which is also not shown. The coil-shaped part of the capillary tube serves to heat the lubricant which is disposed therein, because the heat of the spinning ring, which is not shown, is transferred to the ring 66 and from this to the capillary tube. The viscosity of the lubricant is reduced as a result of the heating, thus facilitating its delivery to the points which are to be lubricated. It is also possible to arrange a plurality of capillary tubes in the ring 66 instead of just one, the outlet openings of which tubes may be distributed over the periphery.

Although only a preferred embodiment is specifically illustrated and described herein, it will be appreciated that many modifications and variations of the present invention are possible in light of the above teachings and within the purview of the appended claims without departing from the spirit and intended scope of the invention.

We claim:

1. An apparatus for lubricating a ring traveller on a spinning or twisting ring of a ring spinning or ring twisting frame, comprising:

a store containing a lubricant and at least one lubricant outlet opening connected to said store;

said at least one lubricant outlet opening being spaced apart from the contact surface between the ring traveller and the spinning or twisting ring in the direction of flow of the air current which occurs during spinning or twisting;

said spinning or twisting ring upon which said ring traveller is arranged being shaped to provide an underpressure zone facing said lubricant store a distance away therefrom; and said at least one lubricant outlet being arranged in said underpressure zone.

2. The apparatus according to claim 1, wherein said lubricant store is annular in shape, is directly adjacent to the spinning or twisting ring to which it is connected, and has a plurality of lubricant outlet openings which are distributed over the periphery of said store.

3. The apparatus according to claims 1 or 2, wherein said store contains a sintered material for absorbing the lubricant.

4. The apparatus according to claims 1 or 2, wherein said store contains an open-pored, porous plastic material for absorbing the lubricant.

5. The apparatus according to claim 3, wherein said pluraity of lubricant outlet openings are formed by the pores of said sintered material.

6. The apparatus according to claim 4, wherein said plurality of lubricant outlet openings are formed by the pores of said plastic material.

7. The apparatus of claim 1, wherein said at least one lubricant outlet opening is disposed in front of the contact surface between the ring traveller and the spinning or twisting ring in the direction of flow of the air current which occurs during spinning or twisting.

8. The apparatus of claim 1, wherein said spinning or twisting ring has a flange facing said lubricant store upon which said ring traveller is arranged, said flange being shaped to provide said underpressure zone.

* * * * *